US007377060B1

(12) United States Patent
Abramyan et al.

(10) Patent No.: US 7,377,060 B1
(45) Date of Patent: May 27, 2008

(54) DEVICE AND METHOD FOR DISPLAY OF INFORMATION

(76) Inventors: Grigor Abramyan, 1853 Garfield Pl., Los Angeles, CA (US) 90028; Edgar Abramyan, 1853 Garfield Pl., Los Angeles, CA (US) 90028

( * ) Notice: Subject to any disclaimer, the term of this patent is extended or adjusted under 35 U.S.C. 154(b) by 127 days.

(21) Appl. No.: 11/113,725

(22) Filed: Apr. 25, 2005

(51) Int. Cl.
*G09F 3/04* (2006.01)

(52) U.S. Cl. ..... 40/449; 40/450

(58) Field of Classification Search ..... 40/449, 40/450, 451, 446
See application file for complete search history.

(56) References Cited

U.S. PATENT DOCUMENTS 4,115,936 A * 9/1978 Nidelkoff ..... 40/449
RE30,324 E 7/1980 Seme ..... 83/880
4,220,948 A * 9/1980 Trame ..... 340/815.44
5,315,775 A * 5/1994 Parker et al. ..... 40/450
5,521,578 A 5/1996 DelValle ..... 340/330
5,566,482 A * 10/1996 Smith ..... 40/450
5,577,336 A * 11/1996 Jensen ..... 40/450
6,289,617 B1 9/2001 Snyder ..... 40/584

* cited by examiner

*Primary Examiner*—Cassandra Davis
(74) *Attorney, Agent, or Firm*—Peter Ganjian

(57) ABSTRACT

A display unit that does not use any characters, but uses pieces (or chips) that are housed within prearranged slots on a base unit to form human recognizable characters. The slots are arranged into a group, with each group of slots forming a specific topography within a group that enables a variety of characters to be displayed.

13 Claims, 6 Drawing Sheets

DEVICE AND METHOD FOR DISPLAY OF INFORMATION

BACKGROUND OF THE INVENTION (1) Field of the Invention

This invention relates in general to displays and pertains, more particularly, to plates or plaques capable of displaying human recognizable characters in digital-like appearance.

(2) Description of Related Art

Conventional display units such as address plates or plaques have been in use for a number of years. Reference is made to the exemplary U.S. Pat. Nos. 6,289,617; 5,521,578; and RE 30,324. Regrettably, most conventional displays suffer from obvious disadvantages. With some, the displayed letters or numbers are fixed thereon and cannot be changed. Others use a fixed set of letters or numbers kit to be placed on the address plates or plaques. With the kits, if a sufficient number of characters are not included in the kit or if one or more characters are lost or damaged over the years the user can no longer use the kit or the display. Still others use complex electrical display units that have complicated components and require power, which necessitates expensive alteration to a structure to which the address plate or plaque is connected for accessing power outlets or power storage units.

In light of the current state of the art and the drawbacks to current devices and methods mentioned above, a need exists for a display unit that would allow for a variable number of characters to be displayed without the use of fixed characters or fixed set of characters, and that would be simple to use without any complex contraptions.

BRIEF SUMMARY OF THE INVENTION

The present invention provides a device for display of information, comprising:

a base having slots that are arranged into a group; and pieces that are housed within the slots on the base, forming characters within the group.

One optional aspect of the present invention provides a device wherein the group is comprised of vertically oriented, parallel slots that form two vertical sides of the group;

a horizontally oriented slot that forms a horizontal bottom side of the group;

a first "T" shaped slot that forms a horizontal top side of the group; and a second "T" shaped slot at a center of the group.

Another optional aspect of the present invention provides a device wherein the first and the second "T" shaped slots are hybrid slots that are comprised of a combination of vertical and horizontal orientation of horizontally oriented slot.

Still another optional aspect of the present invention provides a device wherein the vertically oriented, parallel slots forming the two vertical sides of the group are comprised of a first set of vertically oriented parallel slots and a second set of vertically oriented parallel slots, with the first set and the second set aligned along a respective axial length of slots within the first set and the second set.

A further optional aspect of the present invention provides a device wherein the base is further comprised of a first side and a second side, with both the first side and the second side having slots that are arranged into a group.

Yet a further optional aspect of the present invention provides a device wherein each slot within the group is configured as a polygon.

Still a further optional aspect of the present invention provides a device wherein at least one polygonal slot is a hexagon, and at least one other polygonal slot is a hendecagon.

Another optional aspect of the present invention provides a device wherein the group is comprised of four vertically oriented, parallel hexagonal slots, one horizontally oriented hexagonal slot, and two hendecagons.

Still another optional aspect of the present invention provides a device wherein the vertically oriented, parallel hexagonal slots are horizontally separated at a bottom by the one horizontally oriented hexagonal slot, and at a middle and top by the two hendecagons.

A further optional aspect of the present invention provides a device wherein the hendecagon is a hybrid combination of vertical and horizontal orientation of the one horizontally oriented hexagonal slot, forming a "T" shaped groove.

Still a further optional aspect of the present invention provides a device wherein the pieces are configured to substantially conform to a slot form, and have an embossed top.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention.

Referring to the drawings in which like reference character(s) present corresponding parts throughout.

DETAILED DESCRIPTION OF THE INVENTION

With convention display units, the letters or numbers used thereon either are fixed or cannot be changed, or come with a fixed set of letters or numbers kit to be placed on the address plates or plaques. With the kits, if a sufficient number of characters are not included in the kit or if one or more characters are lost or damaged over the years the user can no longer use the kit or the display.

The present invention provides a display unit that does not use any characters, but uses pieces (or chips) that are housed within prearranged slots on a base unit to form human recognizable characters. The slots are arranged into a group, with each group of slots forming a specific topography within a group that enables a variety of characters to be displayed.

Figures 1A, 1B, 1C:
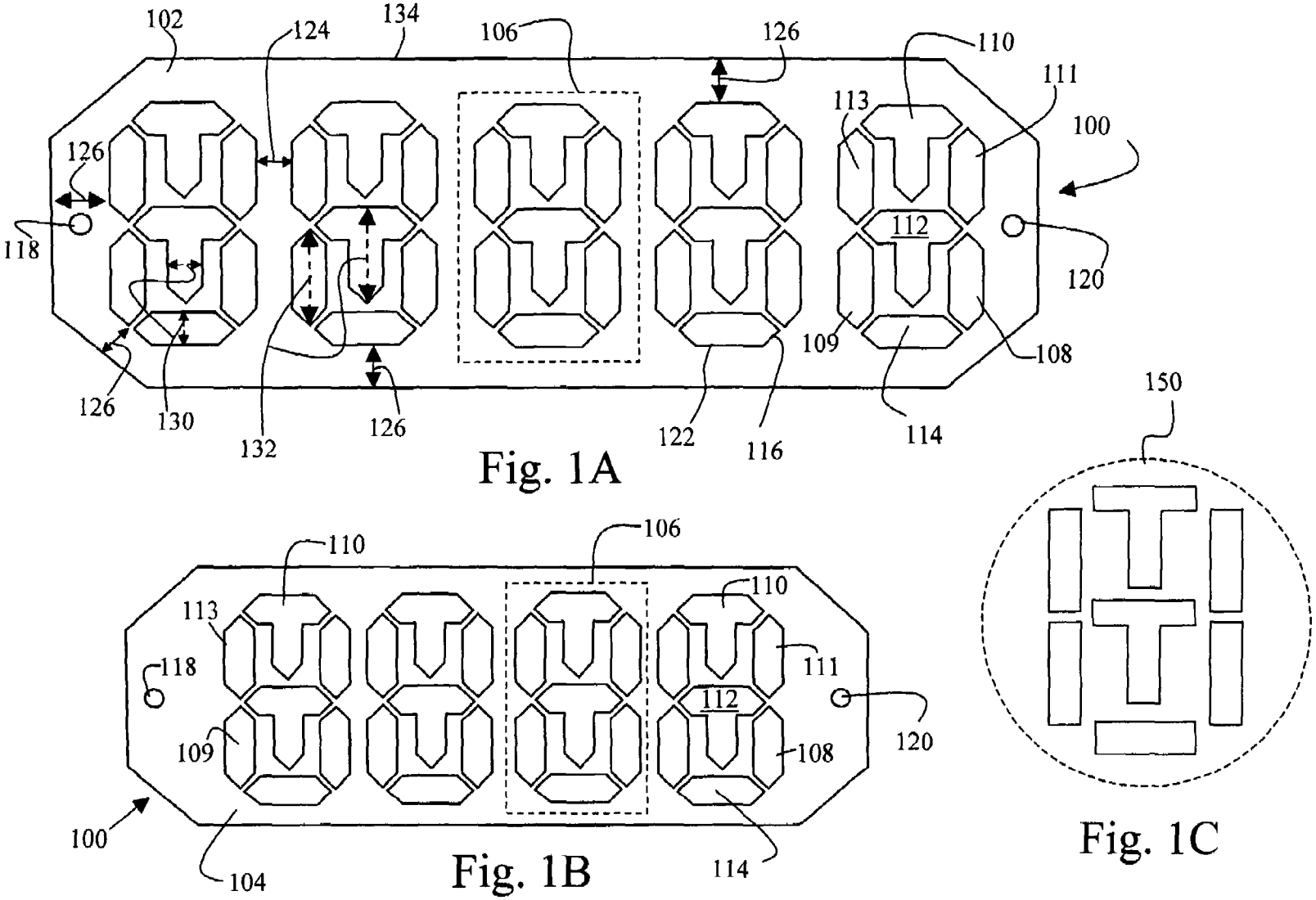
FIG. 1A is an exemplary illustration of a plan or top view of a first side of a base unit in accordance with the present invention.
FIG. 1B is an exemplary illustration of a plan or top view of a second side of the base unit of FIG. 1A in accordance with the present invention.
FIG. 1C is an exemplary illustration of an alternative embodiment for slot shapes in accordance with the present invention.

As illustrated in FIG. 1A, the present invention is comprised of an exemplary octagon base unit 100 that functions as a platform for display of information, and conspicuously distinguishes the content of the information being displayed from the surrounding structure where the base 100 is used. The base 100 includes a first side 102 with one or more groups of slots or grooves 106, with each slot within the groups 106 configured to receive pieces or chips 200 (illustrated in FIGS. 2A to 6) for constructing a character within a group 106. The grouping of slots is illustrated by the dashed line 106 around one exemplary group of slots. Each group 106 is comprised of vertically oriented slots 108, 109, 111, and 113, a horizontal slot 114, and hybrid slots 110 and 112. The hybrid slots 110 and 112 are comprised of merged combination of vertically and horizontally oriented slots. The outer perimeter of each group 106 is comprised of vertical slots 108 and 111 at the right side of the group 106, and vertical slots 109 and 113 at the left side, with the right side slots (108 and 111) oriented parallel in relation to the left side slots (109 and 113). The outer perimeter of each group 106 further includes the horizontal slot 114 at the bottom, and the hybrid slot 110 at the top. That is, each group 106 is comprised of six outer slots with two sets of vertical slots (108 and 111) and (109 and 113), with each vertical set parallel to one another and separated by the horizontal slot 114 and the two hybrid slots 110 and 112.

As further illustrated in FIG. 1A, each slot has an exemplary polygon configuration with the vertical slots 108, 109, 111, and 113, and the horizontal slot 114 having an exemplary hexagon configuration and the hybrid slots 110 and 112 having an exemplary hendecagon configuration. The bottom slot 114 is perpendicularly oriented with respect to the first set of bottom vertical slots 108 and 109. The two bottom vertical slots 108 and 109 are oriented parallel to one another, and longitudinally aligned along their respective axial length with the two upper parallel, vertically oriented slots 111 and 113. The hybrid slots 110 forms the top side of the group 106, with the hybrid slot 112 positioned within the center of the group. The above pattern is repeated for each group 106.

Illustrated in FIG. 1A are also exemplary aperture 118 and 120 that enable the base 100 to be coupled to a support structure such as a wall (not shown). As well be readily recognized by those skilled in the art, the size (height, width, and thickness) of the base 100 as well as the size and or the number of groups 106 on base 100 may easily be varied. The sizes of each group 106 may be varied (increased or decreased) by proportionally varying the sizes of each individual slot (height 132, width 130, depth 306 (illustrated in FIG. 3), and the thickness of the separation walls or distances 310 between each slot (also illustrated in FIG. 3)).

The sizes of each group 106 may also be enlarged by increasing the number of slots within each group 106. For example, the number of vertical slots, the horizontal slot, and the hybrid slots may be increased to increase the height and width of each group 106. The sizes of each group 106 may also be maintained while still increasing the number of slots within the groups 106. This can be done by reducing the sizes (height 132 and width 130) of the slots within each group 106.

In addition, it should be obvious to those skilled in the art that an increase (or decrease) in the size or the number of each group 106 on the base 100 would require a proportional increase (or decrease) in the size of the base 100 to maintain correct viewing or visibility of displayed information. Further, the distance 124 between the groups 106 and the distance 126 between the groups 106 and the perimeter edge 134 of the base 100 must also vary proportionally for correct viewing of the information displayed on the base 100. In general, regardless of any variations in the number and or size of slots within a group, most groups must comprise of topographical (positional) orientation of slots that include at least two parallel, vertically oriented slots that form the two vertical sides of a group, a horizontal slot that forms a bottom, a hybrid slot forming a top (and a center), and a hybrid slot within a center of a group. With the hexagonal configuration however, it is preferred to have the four vertical slots (108, 111, 109, and 113) as illustrated in the FIGS. 1A and 1B.

In addition to variation in the sizes of each slot to vary the size of each group, the actual form or shape of each slot may also be varied. For example, instead of using five hexagons and two hendecagon, one could easily substitute therefor five rectangles and two octagons, respectively, as referenced by the exemplary grouping 150, illustrated in FIG. 1C. In fact, any shape slot (circular, elliptical, including shapes of recognizable items, etc.) may be used, as long as the topographical (positional) orientations of all the slots in relation to one another are maintained. In other words, regardless of the individual shapes of the individual slots or grooves, the arrangements of the slots in relation to one another that form a group must be maintained. In addition, regardless of the actual shape of each slot, the top and the center hybrid slots must comprise of combination of vertical and horizontal orientations of other non-hybrid horizontally oriented slot, forming a "T" like structure. The illustrated hexagon/hendecagon configuration is preferred because they provide a clear separation between one slot from an adjacent neighboring slot, especially when chips 200 (illustrated in FIGS. 2A to 6) is housed within the slots. This allows for clear and conspicuous representation of characters (as apparent in FIGS. 4 to 6).

In general, the size and the distances between each group 106 on base 100 are preferably configured to allow viewing of information displayed from approximately 200 ft. For an exemplary viewing distance of 200 ft, the groups 106 have an exemplary height of about 5 and ¼ inches, with an exemplary width of about 3 inches, and an exemplary distance 124 between each group of about ¾ of an inch. The exemplary height 132 of each slot is about 2 and ⅛ inches, with an exemplary width 130 of about ¾ of an inch. The distance 126 between the outer perimeter of each group 106 and the surrounding edge 134 around the base 100 is about 1 inch. FIG. 1B is an exemplary illustration of a plan or top view of the second side 104 of the base 100 of FIG. 1A in accordance with the present invention. As illustrated, the second side 104 includes four exemplary groups 106 instead of the five groups illustrated in FIG. 1A.

Figure 2B:
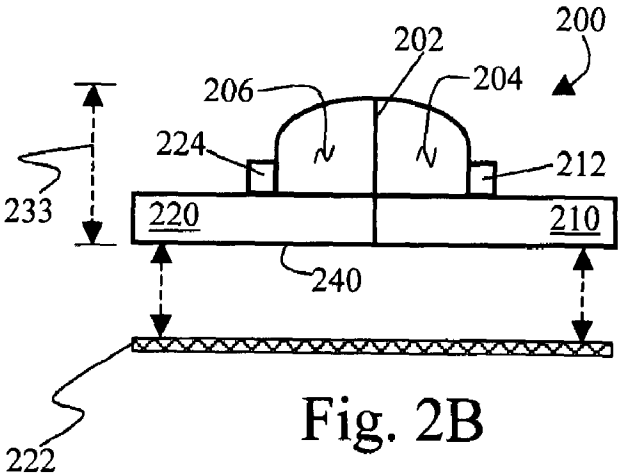
FIG. 2B is an exemplary illustration of a side view of the piece or chip of FIG. 2A in accordance with the present invention.
Figure 2C:
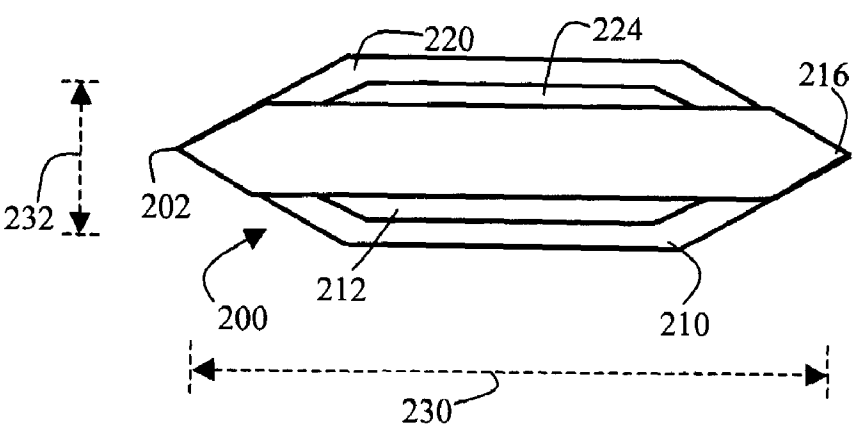
FIG. 2C is an exemplary illustration of a top or plan view of the piece or chip of FIG. 2A in accordance with the present invention.
Figure 2A:
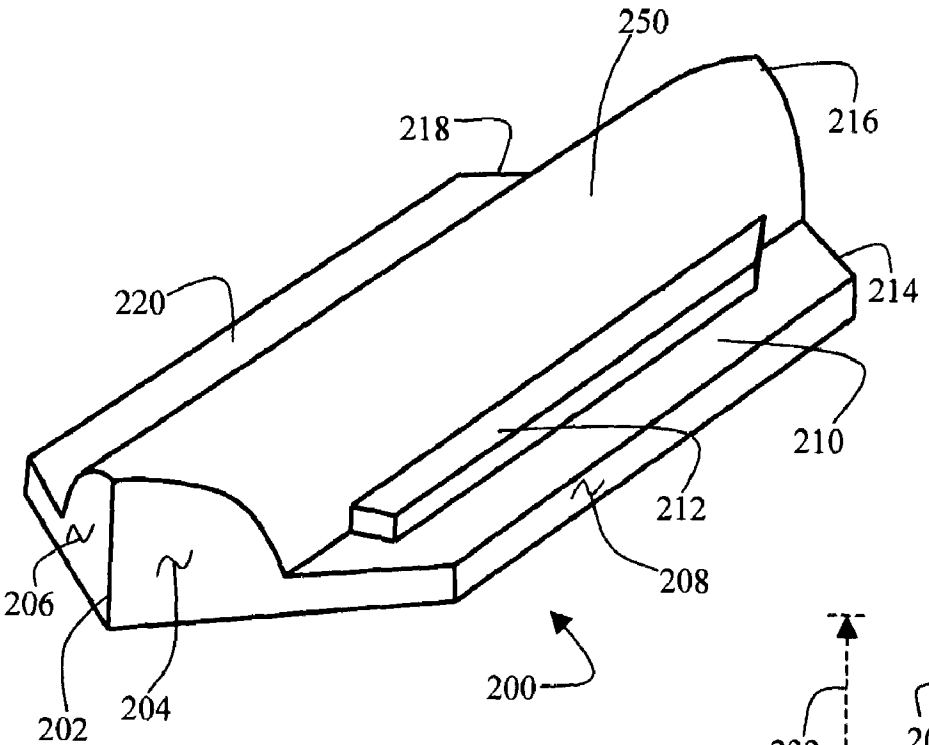
FIG. 2A is an exemplary illustration of a perspective view of a piece or chip in accordance with the present invention.

FIGS. 2A to 2C are exemplary representation of a piece or chip 200 in accordance with the present invention, which are configured to be placed within any of the slots (illustrated in any of the figures). The chip 200 is comprised of identical vertexes 202 and 216, formed from respective walls (204 and 206) and (214 and 218) that intersect at an angle. The chip 200 is further comprised of two straight sides 210 and 220 that form the length of the chip. The chip further includes a generally flat bottom 240, and an embossed top 250 with an exemplary height 233 of about ¼ of an inch. In general, the thickness 208 of the base of the chip 200 is substantially equal to the depth 306 (illustrated in FIG. 3) of the slots. Hence, when the chip 200 is housed within the slots (without the double-sided adhesive tapes 222), the surface of the sides 210 and 220 of the chip 200 are flush with main surface 300 (illustrated in FIG. 3) of the base 100, with the edge thickness 208 completely submerged within the slots. The length 230 of each chip 200 is in general shorter than the height 132 of each slot, and the width 232 of each chip 200 is generally narrower than the width 130 of each slot. This enables the chip 200 to snug-fit tightly within each slot.

In general, the chip 200 should have a configuration that is commensurately delineated to match the general shape of the slots where the chip 200 is placed and housed. All chips 200 are equal in size, and can fit in any of the slots. In an exemplary alternative embodiment where only two parallel, vertically oriented side-slots are used, one or more chips may be housed within each vertical side-slot as needed. The use of equally sized chip 200 allows the pieces to be interchangeable or be replaced with a new chip in case some are lost or damaged. With the use of equal chip sizes, the user need not select any particular piece for a specific slot. This makes the assembly of a character within a group 106 very simple for users. The protrusions 212 and 224 at each side of the chip 200 are designed for aesthetics, and may be removed or varied. In fact, the only requirement for the form of the chip 200 is to have the chip 200 configured to match the general slot shapes, and have an embossed top 250. For example, the bottom perimeter of the chip 200 may be the shape of a hexagon (generally matching the slots in the FIGS. 1A and 1B), and the embossed top 250 in the shape of a recognizable object, item, or character. The embossment 250 allows for a better viewing of the characters especially in varying light conditions by preventing direct reflection of light from the displayed characters. This overcomes the prior art flat surface painted signs that tend to behave like mirrors or glasses that reflect the direct sunlight, which may hinder a user's view of the characters that are displayed. The chip 200 may be removably housed within the slots by a plethora of methods, a preferred nonlimiting example of which may include the use of the exemplary illustrated double-sided adhesive tape 222, coupled to the bottom side 240 of the chip 200 to enable the chip 200 to removably couple to the base 100 within each slot. The double-sided tape 222 is completely housed within the slots, removably connecting the chip 200 to the surfaces of the engraved slots on the base 100.

Figure 3:
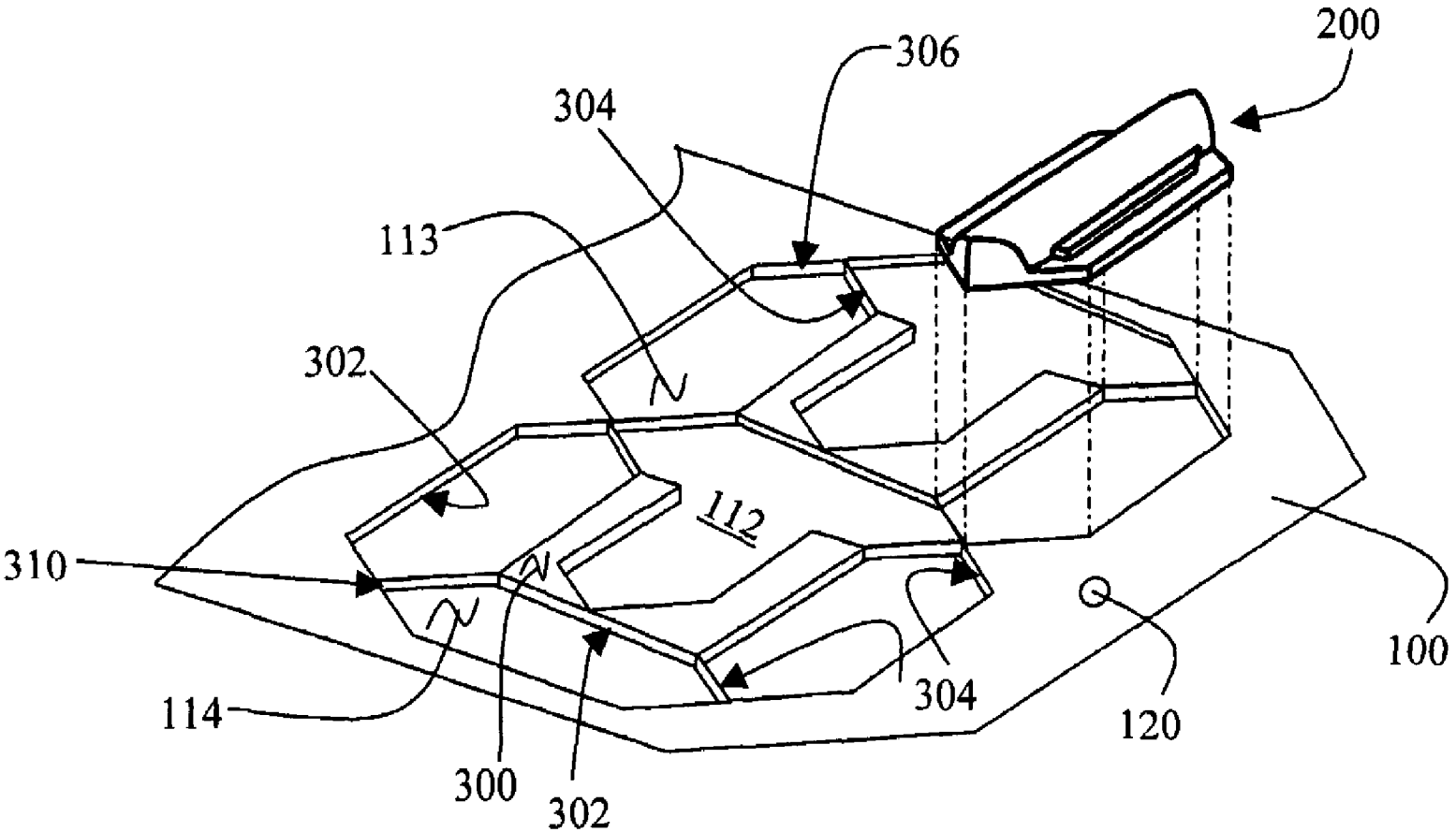
FIG. 3 is an exemplary perspective illustration showing the placement of a piece or chip onto a base unit in accordance with the present invention.

FIG. 3 is an exemplary perspective illustration showing the placement of a piece or chip 200 within an exemplary vertical slot on the base 100 in accordance with the present invention. The slots provide housing for the chips 200, with each slot configured in a predetermined orientation in relation to an adjacent slot to allow users to easily assemble desired characters by the placement of the chips 200 within the prearranged slots. Each slot forms a "housing" for each chip 200, constituted by the walls 302 and 304 with an exemplary thickness 310 of about $1/16^{th}$ of an inch. The depth 306 (or the height of the walls 304 and 302) of each slot is in general sufficient to cover the double-sided adhesive 222 and a substantial portion of the thickness 208 of the sides 210 and 220 of the chip 200. Hence, all sides of the chip 200 partially protrude out of the slots (their respective housing), and are not flush with the surface of the base 100 when the adhesive tape 222 is used. The embossment surface 250 of the chip 200 protruding from the slots of the base 100 aids in the viewing of information when the chips are assembled to form a human recognizable character. It should be noted that no tools are required to assemble the pieces 200 onto the base 100. The surfaces 300 illustrated in FIG. 3 are mere continuation of the general surface of the base 100, but look embossed because of the surrounding grooves or slots.

Figure 4:
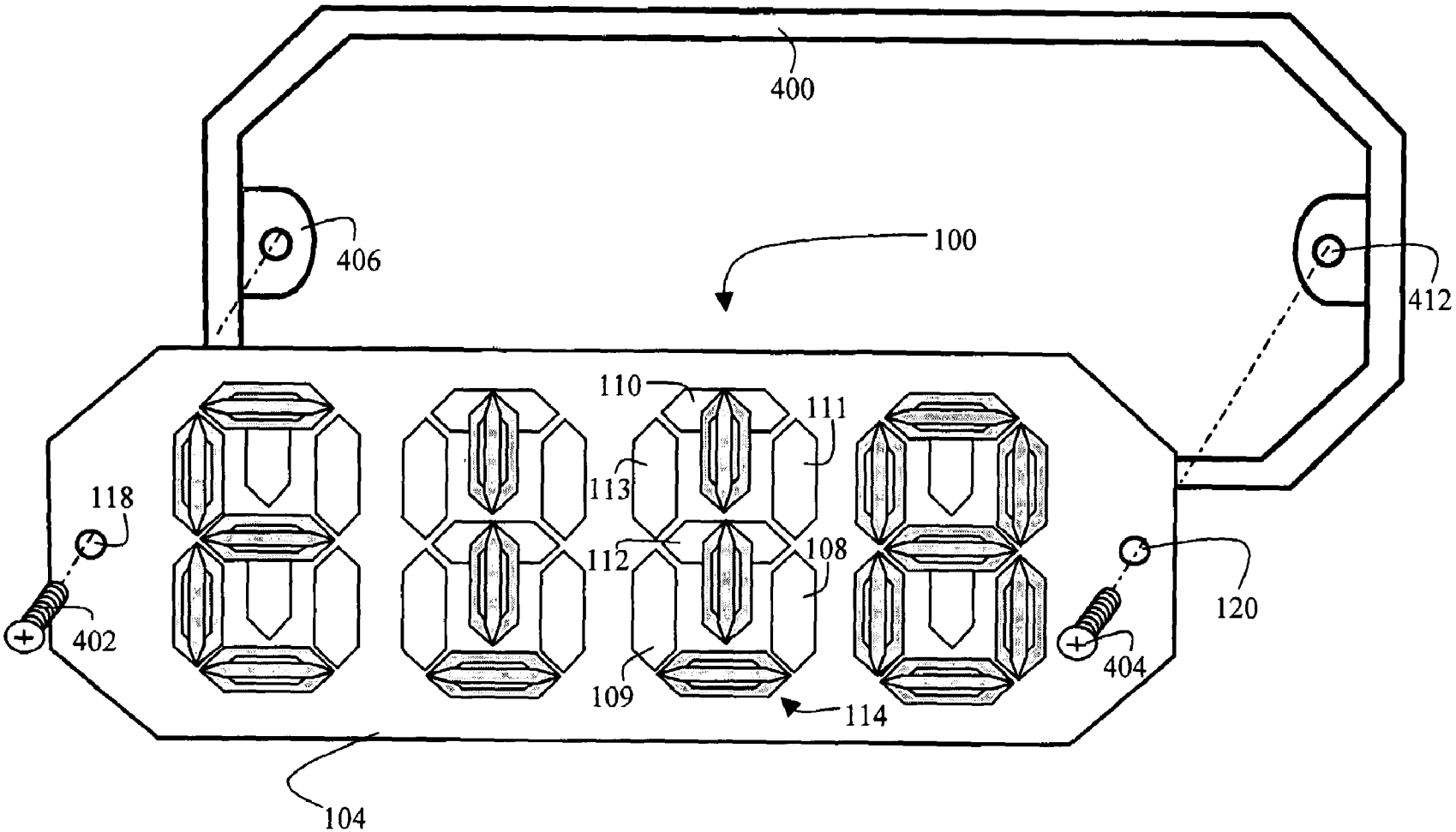
FIG. 4 is an exemplary illustration of an unassembled display unit, including pieces or chips coupled to the second side of a base in accordance with the present invention.

FIG. 4 is an exemplary illustration of an unassembled display unit, including pieces or chips 200 coupled to the second side 104 of the base 100 in accordance with the present invention. As illustrated, the displayed information is alphanumeric, displaying the characters "E," "1," "1," and "8." The hybrid slots 110 and 112 enable the character representing the number one to be centered within the group 106, rather than to one or the other side thereof inside one of two sets of vertical side slots (108 and 111) or (109 and 113). The placement of the chips 200 within the side slots would make the character "1" too close or too far away from the adjacent characters within the neighboring groups of slots. The hybrid slots 110 and 112 create a visual balance in terms of horizontal distances between the displayed characters, creating a visually clear display of information.

The chip 200 placed within slot 114 to form the "underline" of the character "1," also creates a vertical balance in terms of vertical length (height) of any character being displayed, and the length of the adjacent characters housed within the neighboring groups 106. That is, as illustrated, all characters have vertical equal length. Hence, the hybrid slots 110 and 112 provide a visually balanced display of characters in terms of vertical and horizontal appearance, creating a clear display of information. Accordingly, regardless of the characters formed on the groups 106, due to the orientation of the slots in relation to one another, the displayed information is uniform and symmetrical. The hybrid slots 110 and 112 are also used to orient the base 100 with the correct side-up. During assembly, the base 100 is held so that the hybrid slot 110 and 112 are viewed as two "Ts" vertically on top of one another, as illustrated in all the figures. Hence, slot 114 is always at the bottom of the group 106, and the hybrid slot 110 at the top.

Illustrated in FIG. 4 are also the exemplary aperture 118 and 120 that enable the base 100 to be coupled to an optional frame 400 via the respective apertures 406 and 412 on the frame 400. The entire unit may then be coupled or hanged on a support structure such as a wall (not shown). Of course, the base 100 can also couple to a support structure without the use of the optional frame 400. As will be readily apparent to those skilled in the art, the apertures and a set of coupling mechanisms 402 and 404 are only one of a plethora of methods by which the base or the frame may be coupled to each other and to a support structure, which are too numerous in number to mention individually. One nonlimiting example would be to couple the base 100 to the frame 400 by a double-sided adhesive tape or Velcro®. Another would be to couple the two by well-know snap-on or clip-on mechanisms that are comprised of male and female complementary or reciprocal couplers, with the female coupler attached to one (e.g., base 100) and the male attached to the other (e.g., frame 400). Another non-limiting example may include the use of hooks and rings where either the hook or the ring may be coupled to the device or the support structure to hang the display unit. Accordingly, any method of connection may be used.

Figure 5:
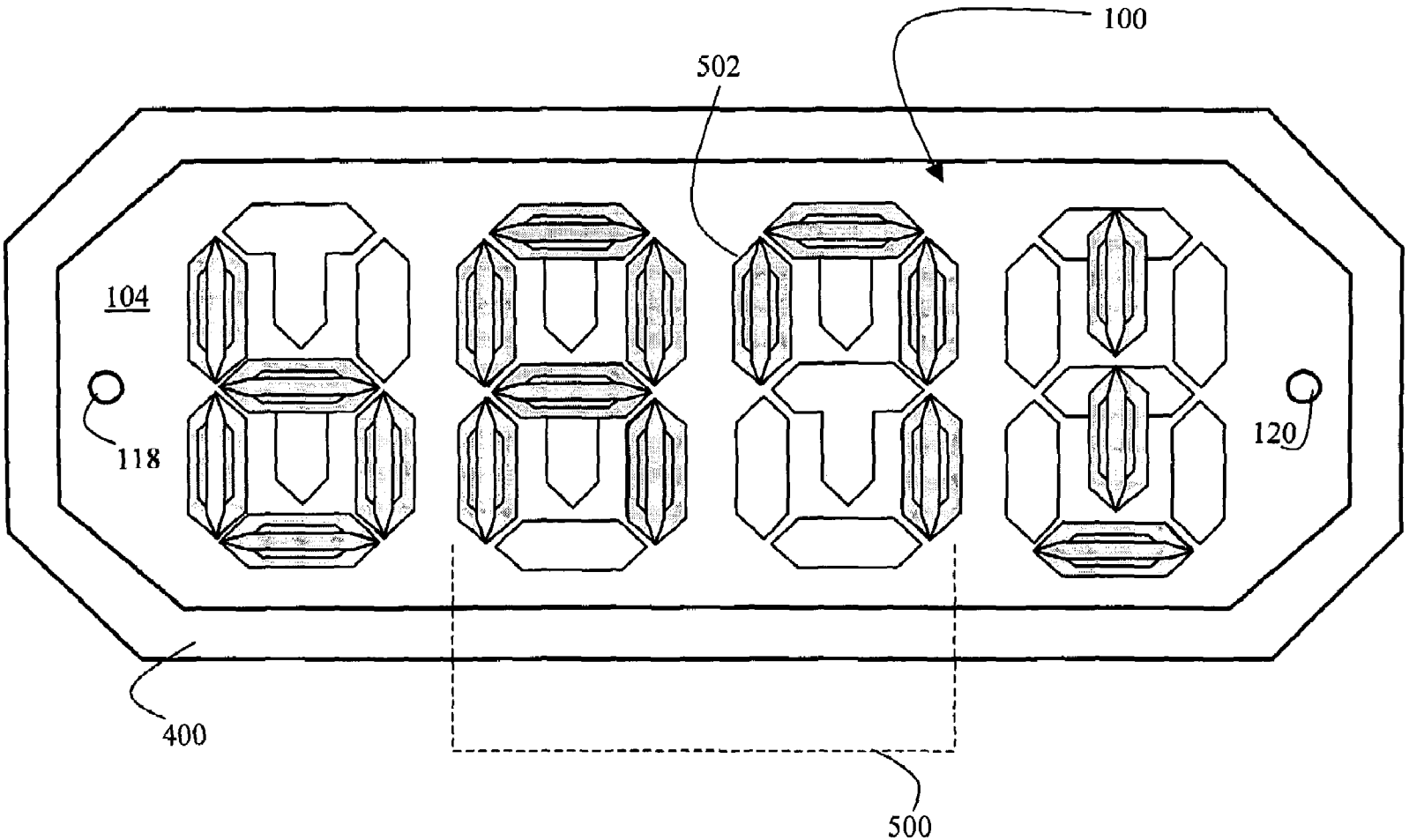
FIG. 5 is an exemplary illustration of an assembled display unit, showing the second side of a base in accordance with the present invention.

FIG. 5 is an exemplary illustration of an assembled display unit, showing the second side 104 of the base 100 in accordance with the present invention, displaying the characters "b," "A," "7," and "1." Of course, the displayed characters may also be assembled in a different manner. For example, the number seven can also be assembled without using the chip 200 pointed to by reference 502. In addition, as indicated by the dashed line 500, instead of using all four groups on the display, user may also use the middle two groups 106 to display the information "A" and "7" rather than use the entire four groups of slots.

Figure 6:
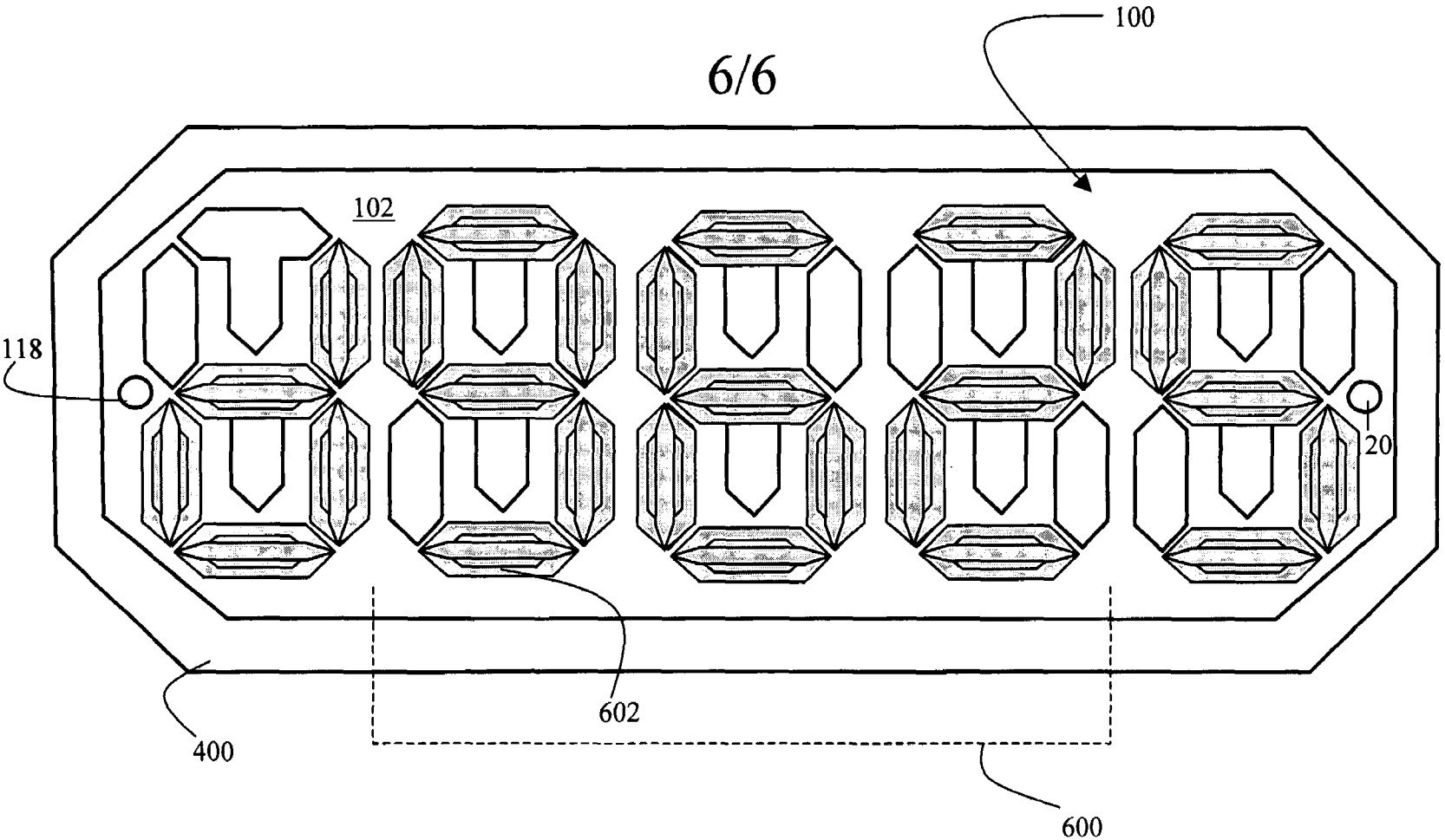
FIG. 6 is an exemplary illustration of an assembled display unit, showing the first side of a base in accordance with the present invention.

FIG. 6 is an exemplary illustration of an assembled display unit, showing the first side 102 of the base 100 in accordance with the present invention, displaying the information "d," "9," "6," "2," and "5." As with the exemplary number seven above, or other characters, the number nine can also be assembled and displayed without using the chip 200 pointed to by the reference 602. In addition, as the dashed line 600 indicates, instead of using all five groups 106 on the display, user may also use the middle three groups to display the information "9," "6," and "2," leaving the others empty.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while illustrative embodiments of the invention have been described, numerous variations and alternative embodiments will occur to those skilled in the art. For example, although the perimeter edge 134 of the base 100 is illustrated as an octagon, any shape that can conspicuously display the information may be used for the base 100. The material used for all components may be wood, plastic, metal, or any material desired. Any color base, chip, or frame combination may be used. The chips 200 may also comprise of engravings or embossments on the top protruded surface 250, incorporating different designs. In addition, a great variety of mechanisms may be used to couple the chip 200 within the slots of the base 100, too numerous to mention individually. The nonlimiting examples of a few may include the use of well-known clip-on or snap-on mechanisms where the chip 200 is snapped or clipped onto the base 100. The nonlimiting examples for clip-on or snap-on coupling mechanisms may include complementary or reciprocal male/female couplers, with the female coupler attached to one (e.g., the chip 200) and the male to the other (e.g., the base 100). Other methods for coupling chip 200 to the base 100 may include the use of Velcro®, similar to the method used to removably couple the chip 200 to the base 100 using the above-described double-sided adhesive tape 222, or magnetic couplers. Such variations and alternate embodiments are contemplated, and can be made without departing from the spirit and scope of the invention.

What is claimed is:

1. A device for display of information, comprising:

a base having a first side and a second side, with both the first side and the second side having recesses that are arranged into a group;

with the group comprising vertically oriented, parallel recesses that form two vertical sides of the group; a horizontally oriented recess that forms a horizontal bottom side of the group; a first "T" shaped recess that forms a horizontal top side of the group; a second "T" shaped recess at a center of the group; and pieces that are detachably housed within each recess and configured commensurately with the shape of the recesses to form and display selective characters within the group.

2. The device as set forth in claim 1, wherein the first and the second "T" shaped recesses are hybrid recesses that are comprised of a combination of vertical and horizontal orientation of horizontally oriented recess.

3. The device as set forth in claim 1, wherein the vertically oriented, parallel recesses forming the two vertical sides of the group are comprised of a first set of vertically oriented parallel recesses and a second set of vertically oriented parallel recesses, with the first set and the second set aligned along a respective axial length of recesses within the first set and the second set.

4. The device as set forth in claim 1, wherein the base is further comprised of a first side and a second side, with both the first side and the second side having recesses that are arranged into a group.

5. The device as set forth in claim 1, wherein each recess within the group is configured as a polygon.

6. The device as set forth in claim 5, wherein at least one polygonal recess is a hexagon, and at least one other polygonal recess is a hendecagon.

7. The device as set forth in claim 1, wherein the group is comprised of four vertically oriented, parallel hexagonal recesses, one horizontally oriented hexagonal recess, and two hendecagons.

8. The device as set forth in claim 7, wherein the vertically oriented, parallel hexagonal recesses are horizontally separated at a bottom by the one horizontally oriented hexagonal recess and at a middle and top by the two hendecagons.

9. The device as set forth in claim 7, wherein the hendecagon is a hybrid combination of vertical and horizontal orientation of the one horizontally oriented hexagonal recess, forming a "T" shaped groove.

10. The device as set forth in claim 1, wherein the pieces are configured to substantially conform to a recess form, and have an embossed top.

11. A method for display of information, comprising the acts of: providing a base having a first side and second side; arranging recesses into a group on both the first side and second side of the base; with the act of arranging of the recesses into the group comprising of providing vertically oriented, parallel recesses that form two vertical sides of the group, a horizontally oriented recess that forms a horizontal bottom side of the group, a first "T" shaped recess that forms a horizontal top side of the group, and a second "T" shaped recess at a center of the group; and housing pieces within the recesses on the base for forming characters within the group.

12. The method as set forth in claim 11 wherein the first and the second "T" shaped recesses are hybrid recesses that are comprised of a combination of vertical and horizontal orientation of horizontally oriented recess.

13. The method as set forth in claim 11, wherein the vertically oriented, parallel recesses forming the two vertical sides of the group are comprised of a first set of vertically oriented parallel recesses and a second set of vertically oriented parallel recesses, with the first set and the second set aligned along a respective axial length of recesses within the first set and the second set.

* * * * *